US007491876B2

(12) United States Patent
Peacock

(10) Patent No.: US 7,491,876 B2
(45) Date of Patent: Feb. 17, 2009

(54) GUITAR STRAP AND METHOD OF MAKING GUITAR STRAP

(75) Inventor: Michael G. Peacock, 142 Hunters Glen Ct., Vacaville, CA (US) 95687-7513

(73) Assignee: Michael G. Peacock, Vacaville, CA (US)

( * ) Notice: Subject to any disclaimer, the term of this patent is extended or adjusted under 35 U.S.C. 154(b) by 142 days.

(21) Appl. No.: 11/257,015

(22) Filed: Oct. 25, 2005

(65) Prior Publication Data

US 2006/0086232 A1 Apr. 27, 2006

Related U.S. Application Data

(60) Provisional application No. 60/621,069, filed on Oct. 25, 2004.

(51) Int. Cl.
*G10D 3/00* (2006.01)

(52) U.S. Cl. ..... 84/327

(58) Field of Classification Search ..... 84/329, 84/327; 450/86; 224/257, 910, 264
See application file for complete search history.

(56) References Cited

U.S. PATENT DOCUMENTS

| | | | | |
|---|---|---|---|---|
| 2,510,799 | A | 6/1950 | Carley | |
| 3,105,406 | A | 10/1963 | Ippolito | |
| 3,403,430 | A | 10/1968 | Steinborn | |
| 3,753,267 | A | 8/1973 | Johnson, Sr. | |
| 4,251,016 | A | 2/1981 | O'Rafferty et al. | |
| 4,286,011 | A * | 8/1981 | Wong | 428/220 |
| 4,858,801 | A * | 8/1989 | Sameniego | 224/264 |
| 5,332,137 | A * | 7/1994 | Violette | 224/257 |
| 5,432,322 | A | 7/1995 | Ingram et al. | |
| 5,827,589 | A * | 10/1998 | Autterson | 428/40.1 |
| 6,199,731 | B1 | 3/2001 | Lehoux | |
| 6,581,812 | B2 | 6/2003 | Roscoe-Dare | |
| 6,598,772 | B1 | 7/2003 | Wilfer | |
| 2003/0041718 | A1 * | 3/2003 | Standish | 84/280 |
| 2004/0020344 | A1 | 2/2004 | Bazata | |
| 2004/0060951 | A1 | 4/2004 | Kelly | |
| 2004/0094585 | A1 | 5/2004 | Walker | |
| 2005/0020184 | A1 * | 1/2005 | Izcoa | 450/86 |
| 2006/0065683 | A1 | 3/2006 | Armstrong | |
| 2007/0261532 | A1 | 11/2007 | Neagle | |

FOREIGN PATENT DOCUMENTS

DE 4019416 A1 2/1999

* cited by examiner

*Primary Examiner*—Kimberly R Lockett
(74) *Attorney, Agent, or Firm*—Antonelli, Terry, Stout & Kraus, LLP.

(57) ABSTRACT

A cushioning guitar strap reduces unit load on the shoulder by the use of a relatively wide cushioning pad formed with a soft flexible foam layer to conform to a user's shoulder under the load of a guitar, with a flexible film, which is dimensionally stable in use under the load of a guitar, bonded to the foam layer to transfer the load over the area of the pad. Front and back straps connected to the cushioning pad each have a quick connect-disconnect adjustment mechanism permitting adjustment of strap length while the guitar strap is in use over the shoulder supporting a guitar.

22 Claims, 3 Drawing Sheets

GUITAR STRAP AND METHOD OF MAKING GUITAR STRAP

RELATED APPLICATION

Applicant claims priority of U.S. provisional patent application Ser. No. 60/621,069 filed Oct. 25, 2004 the disclosure of which is hereby incorporated by reference.

TECHNICAL FIELD

The present invention is an improved cushioning shoulder strap, particularly a cushioning guitar strap, and a method of making the same.

BACKGROUND

Most guitar straps feature nothing more than a two inch wide strap, made of leather or nylon webbing (with no padding) that goes over the shoulder to support the weight of the guitar. A few guitar straps have various types and sizes of pads for the shoulder, but to accommodate different body shapes, sizes, and guitar positions, the pad must be movable along the length of the strap to keep it positioned on top of the shoulder thereby providing some comfort. This adjustment is accomplished in some cases, as in the published patent application to Walker, US 2004/0094585, by running the strap through a series of loops over the top of the pad thus allowing the pad to be moved along the length of the strap. The drawback of this type of pad arrangement is that the load is not applied to the full width of the pad because the portion of the pad that extends out beyond the two inch width of the strap will, due to its softness, flex upward away from the body, thereby not supporting the load which the strap is applying to it.

Sameniego, U.S. Pat. No. 4,858,801, discloses a variation of this pad arrangement wherein, for movement of the pad along the length of the strap, the pad or cushion is detachably connected in one of several different positions on the strap using hook and loop fasteners, such as Velcro stripping. More recently, Kelly discloses in U.S. published patent application no. US 2004/006095 A1, the use of a flexible bladder as a pad. The bladder is inflatable or prefilled and may be formed integrally with or removably placed onto the strap. A valve in the bladder permits inflation with a gas, a liquid or a gel. There is a need for an improved cushioning guitar strap which is simple, easy to use, and adaptable to a wide range of body shapes, sizes and guitar positions, while providing improved cushioning of the shoulder under the load of the guitar.

The most common known method of adjustment of the length of a guitar strap is the use of a sliding buckle attached permanently to one end of the strap. The other end of the strap is threaded through the buckle to form a loop in the guitar strap. The buckle is slid relative to the strap end threaded therethrough to adjust, e.g. shorten or lengthen, the guitar strap. In order to adjust the sliding buckle, the strap has to be taken off the shoulder and off the guitar, the buckle adjusted, then the guitar strap must be reinstalled on the shoulder and the guitar to check for proper adjustment. If further adjustment is required, this process must be repeated until adjustment is to the user's liking.

Another known method of adjustment of the length of a guitar strap involves the use of a narrow one inch wide strap that is threaded through a slot in a two inch wide strap then doubled back and buttoned to itself in one of several positions to change the length of the strap assembly. Still another known method involves the use with a one piece strap having several button holes in a row on the back end of the strap which allows the back of the guitar to attach in several locations, thus changing the effective strap length and, in turn, the height of the guitar for the player. While these two methods may be easier to adjust than a sliding buckle, they offer very limited adjustability.

SUMMARY

The present invention is directed to an improved cushioning guitar strap which overcomes the aforementioned drawbacks and limitations of the currently used guitar straps, providing increased comfort, ease of use and adjustability without requiring the guitar player to remove the guitar strap from his shoulder or the guitar to adjust the guitar strap.

To this end, according to a disclosed preferred embodiment, the cushioning guitar strap of the invention comprises an elongated, flexible cushioning pad having a first end and a second end. A first coupling means is connected to the first end of the cushioning pad and a second coupling means connected to the second end for coupling the guitar strap to a guitar. The cushioning pad includes a flexible foam layer with a first surface on one side to conform to a user's shoulder under the load of a guitar. A flexible film, which is dimensionally stable in use under the load of the guitar, is bonded to a second surface on an opposite side of the foam layer to transfer the load over the area of the pad between said first and second ends. In accordance with the invention, the width of the elongated cushioning pad is at least four inches. This feature, together with the fact that the foam layer is soft and flexible to easily conform to the uneven bony area of the shoulder where there is insufficient natural padding, and the use of the dimensionally stable flexible film bonded to the foam layer to ensure that the load is applied to the foam pad across its full width, result in improved load distribution, e.g. lower unit load on the shoulder area, which increases comfort and playability of the musical instrument when using the improved cushioning guitar strap of the invention.

The first and second coupling means in the example embodiment respectively include first and second straps connected at their ends to respective ones of the first and second ends of the cushioning pad. Each of the straps has an adjustment mechanism permitting the user to adjust the length of the first and second straps for changing the height of the guitar on the body. The adjustment mechanisms are located at the ends of the first and second straps remote from the cushioning pad. The adjustment mechanisms have a quick connect-disconnect structure actuable by the user from a side of the guitar strap, the bottomside, which faces the user's body, to permit the user to quickly adjust strap length of either of the first and second straps, and thus the position of the guitar relative to the user's body, while the guitar strap is over the user's shoulder and connected to a guitar.

These and other features and advantages of the invention will be more apparent from the following detailed description taken with the accompanying drawings.

DETAILED DESCRIPTION

Figure 1:
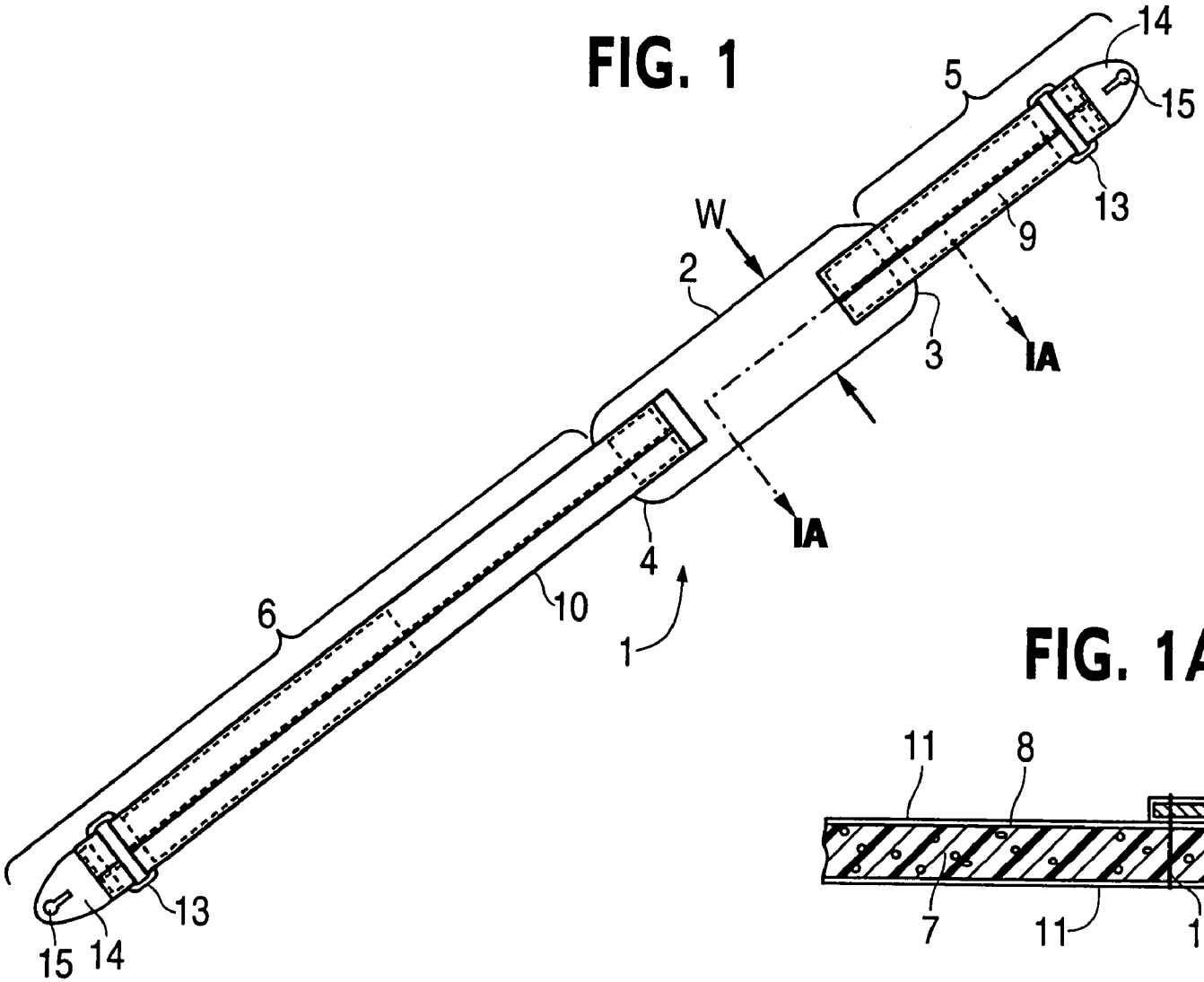
FIG. 1 is a perspective view from above and to one side of a cushioning guitar strap according to a preferred embodiment of the invention.

Referring now to drawings, a cushioning guitar strap 1 according to the example embodiment of the invention is seen to comprise an elongated, flexible cushioning pad 2 having a first end 3 and a second end 4. A first coupling means 5 is connected to the first end and a second coupling means 6 is connected to the second end for coupling the guitar strap to a guitar. The cushioning pad includes a flexible foam layer 7 with a first, bottom surface on one side to conform to a user's shoulder under the load of guitar. A flexible film 8, which is dimensionally stable in use under the load of a guitar, is adhesively bonded to a second, top surface on an opposite side of the foam layer to transfer the load over the area of the pad between the first and second ends.

The width W, FIG. 1, of the elongated cushioning pad is preferably at least four inches to reduce the unit load applied to the shoulder area of the human body from the weight of a guitar, such as an electric solid body or acoustic hollow body guitar. Unit load in this application can most simply be expressed on pounds per square inches (psi). For example, a ten pound load applied to an area of one inch by two inches, which would be two square inches, would result in a unit load of 5 psi. Increasing the area to 10 square inches, results in a unit load of 1 psi. By decreasing the unit load to the shoulder area according to the present invention, comfort and playability are greatly increased.

The first coupling means 5 includes a first, front strap 9 connected to the first end of the cushioning pad. The second coupling means 6 includes a second, back strap 10 connected to the second end of the cushioning pad. The straps 9 and 10 are sewn directly and securely to the ends of the cushioning pad, so that a strap never goes across the top of the pad, see FIGS. 1, 1A and 7. This method of attachment, together with the construction of the cushioning pad as discussed below, transfers the load to the entire surface area of the pad, not just the center of the pad's width.

Figure 1A:
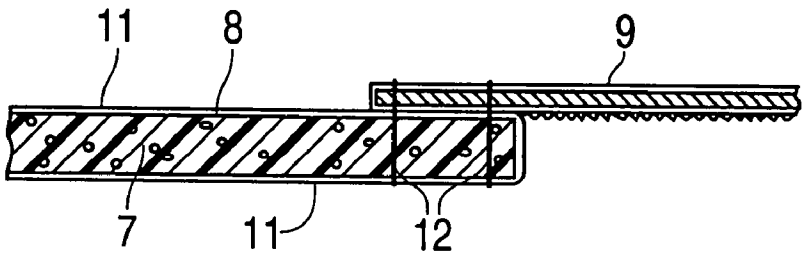
FIG. 1A is a cross sectional view of a portion of the cushioning pad and front strap of the guitar strap of FIG. 1 taken along the line IA-IA.
Figure 2:
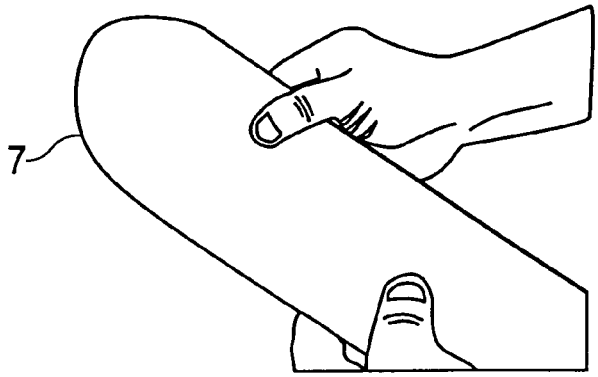
FIG. 2 is a bottom view of the flexible foam layer used to form the cushioning pad of the guitar strap of FIG. 1.
Figure 3:
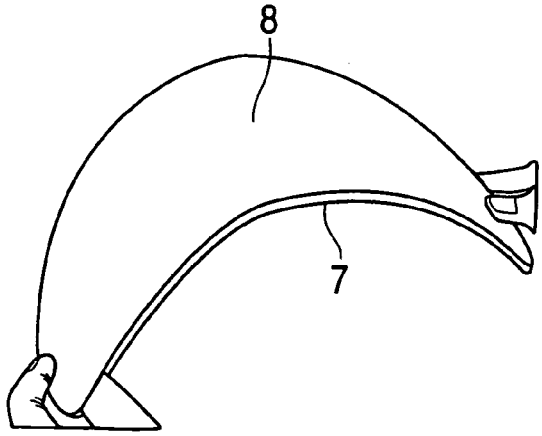
FIG. 3 is a perspective view from one side and above the flexible foam layer of FIG. 2 showing a flexible, dimensionally stable film adhesively bonded to the outer side of the foam layer, the composite being shown flexed to a shoulder-like, curved configuration.

The foam layer 7 of the cushioning pad is made of a soft flexible foam, see FIGS. 1A, 2 and 3, that will under the load of a guitar easily conform to the uneven bony area of the shoulder where there is insufficient natural padding. Preferably the compression deflection @ 25% of the foam is within the range of 1.0-4.0 pounds per square inch. This softness and flexibility allows the load to be applied evenly to the whole surface of the shoulder, not just the high spots. In the example embodiment the foam is a three eights inch thick layer of closed cell polyvinyl chloride/nitrile foam having a density of 3.0-4.5 pounds per cubic foot (psf) and a hardness as measured by a compression deflection @ 25% of 1.52-3.5 pounds per square inch. Such a foam is Ensolite MLC-2 manufactured by Rubber Lite Inc. of Huntington, W. Va. This foam has a tensile strength of 40 pounds per square inch. Of course, other thicknesses and types of foams, foam densities and foam hardnesses could be employed as will be apparent to the skilled artisan.

The flexible film 8 adhesively bonded to the top side of the foam layer in the example embodiment is a thermoplastic polymer film having a thickness less than or equal to 0.010 inch. More particularly, the flexible film is a biaxially oriented polyester film having a thickness of 0.001 to 0.002 inch and a yield strength of at least 10,000 psi at ambient temperature. Specifically, a commercially available film of this type, Mylar by Dupont, having a thickness of 0.001 inch was used in the embodiment. The film was adhesively bonded by the supplier to the entire top side of the foam layer to provide a rigid, yet flexible load bearing support member. That is, because of the high strength of the Mylar film, under the load of a guitar, the film is dimensionally stable, not stressed above its yield strength, so that it transfers the load over the entire area of the pad between the first and second ends. Because of the natural flexibility of the foam layer, without the film bonded thereon, the foam would have a tendency to stretch along its length, in the center of its width, between the two strap attachment points at the ends 3 and 4 under the load of a guitar, thereby applying the load to the center of the pad only. This, in turn, would increase the unit load on the shoulder of the user. The application of the dimensionally stable, flexible film to the foam stops this process by forming a stable load bearing member, insuring that the load is applied to the foam pad across its full width.

The foam layer with flexible film adhesively bonded thereto of the cushioning pad 2 is enclosed within a flexible cover 11 of nylon, for example, by sewing. The top of the cover 11 is formed of 3.5 ounce material and the bottom by 1.9 ounce material in the embodiment but other weights and materials could be used. This entire cushioning pad assembly is sewn to the straps 9 and 10 at the ends 3 and 4 by stitches 12 which extend through the nylon cover, flexible film 8 and foam layer 7, see FIG. 1A, to securely attach the straps to the ends of the cushioning pad.

The first, front coupling means 5 of the cushioning guitar strap includes the first, front strap 9 joined at one end to the cushioning pad and at its opposite end to one side of a steel loop 13. A leather end piece 14 is sewn to a nylon material which is joined to the other side of the two inch wide steel loop. The end piece 14 is for connection to the front strap button on the guitar, which is received in an opening 15 in the leather end piece. The width of the first and second straps 9 and 10 is two inches, e.g. one-half the width of the cushioning pad. The second, back strap 10 is similarly provided with a steel loop 13 and leather end piece 14 with opening 15 for connection with the back strap button on the guitar.

The front and back straps each have an adjustment mechanism located at the ends of the straps remote from the cushioning pad which permit the user to adjust the lengths of the straps for changing the height of the guitar on the body. More particularly, each of the adjustment mechanisms in the example embodiment has a quick connect-disconnect structure 16 actuable by the user from a side of the guitar strap corresponding to the side of the foam layer toward the user's shoulder to permit a user to adjust the strap length while using the guitar strap over the shoulder to support a guitar. The adjustment mechanisms are preferably hook and loop fasteners such a Velcro fasteners which have a two inch long hook portion 17 sewn to the bottom side of the strap at the free end thereof, and a twelve inch long loop portion sewn to the bottom side of the strap inwardly from the hook portion. To secure the strap to the steel loop, the hook portion of the quick connect-disconnect structure is folded over and attached to the pile of the loop portion at any position along the length of the loop portion. This securely attaches the leather end piece carried by the steel loop to the strap, so that, in turn, the guitar strap may be attached to the strap button on the guitar.

Figure 4:
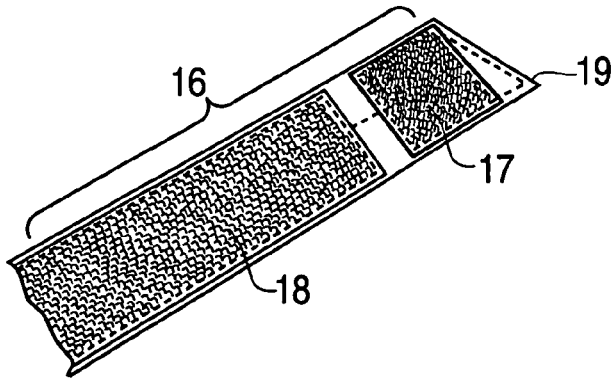
FIG. 4 is a perspective view from above and to one side, depicting the bottom side of the back strap of the guitar strap of FIG. 1 in its unfolded condition showing hook and loop portions of a quick connect-disconnect fastener on the strap.
Figure 5:
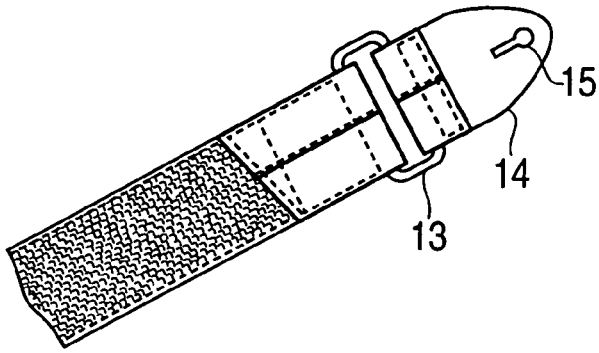
FIG. 5 is a view like that in FIG. 4 but showing the end of the back strap extending through a metal loop of the first coupling means and folded back on the strap with the hook portion engaging a loop portion on the bottom side of the strap to secure a leather end piece to the back strap by way of the metal loop.
Figure 6:
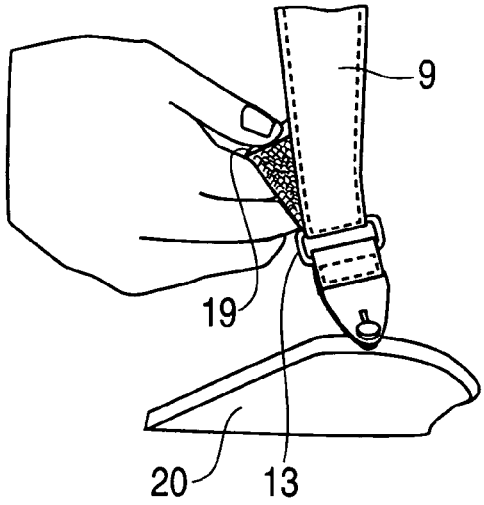
FIG. 6 is a perspective view from the front showing one end of the guitar strap of FIG. 1 in use supporting a guitar on the shoulder of a user with the user grasping a thumb hold on the end of the front strap to adjust the length of the strap while the guitar strap is on his shoulder and connected to the guitar.

Adjustments to the strap length can be performed by the player while wearing the guitar. This is done by grasping the small thumb hold 19 provided at the end of the hook portion, see FIGS. 4 and 6. By simply pulling the hook portion loose from the pile of the loop portion and then pulling the strap further through the steel loop, and reattaching the hook portion on the loop portion, the strap can be adjusted shorter or longer. As noted above, this adjustment can be performed by the guitar player without removing the guitar from his shoulder and without removing the strap from the guitar. Each of the front and back straps has its length adjusted in its manner.

Figure 7:
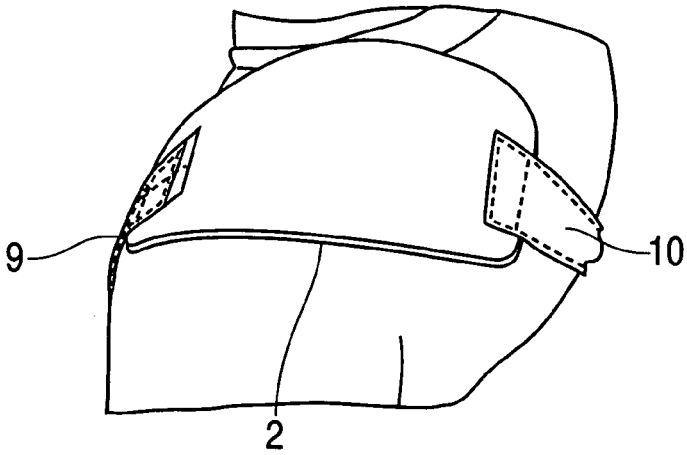
FIG. 7 is a perspective view from above and to one side of the cushioning pad of the guitar strap conforming to a user's shoulder under the load of a guitar being supported on the user's body.

Dual adjustment points, at the outer or free ends of the guitar strap, not only allows for a maximum amount of total adjustment, but also allows for adjustment of the pad placement on top of the shoulder, see FIG. 7. Because each guitar player wears his guitar at a different height and holds his guitar at a different position and due to the different body shapes and sizes, the cushioning pad will often times not be located on the top of the shoulder. This problem is overcome by the individual adjustments of the front and rear straps. For example, if the front strap is adjusted to its minimum length and the rear strap is adjusted to its maximum length, then the pad will come down on the front of the shoulder. If the front strap is adjusted to its maximum length and the rear strap is adjusted to its minimum length, then the pad will come down over the back of the shoulder. These features of the invention allow the cushioning pad to be placed over the top of the shoulder regardless of body size and shape, location of attachment buttons on the guitar and preferred height of the guitar on the player.

The front and back straps 9 and 10 are each formed of a two inch wide fabric stiffener, for example a commercial fabric stiffener known at Tyvek, which is surrounded by a nylon fabric covering and sewn together with the hook and loop portions of the quick connect-disconnect structure as depicted in the drawings. In the example embodiment the front strap has a length in its unfolded state of 17½ inches, which includes a two inch length at its inner end overlapped with and sewn to the top of the cushioning pad. The length of the back strap in the example embodiment, in the unfolded state, is 32½ inches, which includes the two inch length overlapped with and sewn to the top of the cushioning pad. Of course, other strap lengths could be employed to provide guitar straps of different overall lengths. The length of the cushioning pad 2 in the example embodiment is 13 inches and its width is four inches as noted above. The corners of the pad are rounded at the ends, see FIGS. 1 and 2. If desired, different overall lengths of guitar straps could be formed for short, medium, tall users. Because the length of the loop portion 18 on each of the front strap and back strap is twelve inches while the length of the corresponding hook portion 17 is only two inches, each strap can have its length adjusted over a range of ten inches, providing the overall guitar strap with a twenty inch range of adjustability to readily accommodate different body sizes and shapes and guitar positions of the user.

What I have shown and described only a single embodiment of the invention, for supporting a guitar, the invention is also useful as a cushioning shoulder strap for supporting other musical instruments, such as other string instruments or other objects to be carried over the shoulder. The invention is also susceptible to numerous variations and modifications as will be apparent to the skilled artisan without departing from the scope of the present invention. I therefore do not wish to be limited to the details of the example embodiment shown and described herein but only by the scope of the following claims defining the present invention.

I claim:

1. A cushioning guitar strap comprising:

an elongated, flexible cushioning pad having a first end and a second end;

first coupling means connected to the first end and second coupling means connected to the second end for coupling the guitar strap to a guitar;

wherein said cushioning pad includes a flexible foam layer with a first surface on one side to conform to a user's shoulder under the load of a guitar, and a flexible film, which is dimensionally stable in use under the load of a guitar, bonded to a second surface on an opposite side of said foam layer to transfer the load over the area of the pad between said first and second ends;

wherein said first and second coupling means respectively include first and second straps connected respectively to the first and second ends of the cushioning pad; and wherein the cushioning pad further includes a flexible covering over the foam layer and flexible film, and wherein the first and second straps are connected to the respective ends of the cushioning pad by sewn stitching through the covering, foam layer and flexible film.

2. The cushioning guitar strap according to claim 1, wherein a width of said elongated cushioning pad is at least four inches.

3. The cushioning guitar strap according to claim 1, wherein a width of said elongated cushioning pad is at least twice a width of said first and second straps.

4. The cushioning guitar strap according to claim 1, wherein each of said first and second straps has an adjustment mechanism permitting the user to adjust the length of each of said first and second straps for changing the height of the guitar on the body.

5. The cushioning guitar strap according to claim 4, wherein the adjustment mechanisms are located at the ends of said first and second straps remote from said cushioning pad.

6. The cushioning guitar strap according to claim 1, wherein the flexible film is a thermoplastic polymer film having a thickness less than or equal to 0.010 inch.

7. The cushioning guitar strap according to claim 1, wherein the flexible film is a biaxially oriented polyester film.

8. The cushioning guitar strap according to claim 1, wherein said foam layer has a thickness of at least one-quarter inch.

9. A cushioning guitar strap comprising:

an elongated, flexible cushioning pad having a first end and a second end;

first coupling means connected to the first end and second coupling means connected to the second end for coupling the guitar strap to a guitar;

wherein said cushioning pad includes a flexible foam layer with a first surface on one side to conform to a user's shoulder under the load of a guitar, and a flexible film, which is dimensionally stable in use under the load of a guitar, bonded to a second surface on an opposite side of said foam layer to transfer the load over the area of the pad between said first and second ends;

wherein said first and second coupling means respectively include first and second straps connected respectively to the first and second ends of the cushioning pad;

wherein each of said first and second straps has an adjustment mechanism permitting the user to adjust the length of each of said first and second straps for changing the height of the guitar on the body;

wherein the adjustment mechanisms are located at the ends of said first and second straps remote from said cushioning pad; and wherein each of said adjustment mechanisms has a quick connect-disconnect structure actuable by the user from a side of said guitar strap corresponding to said one side of said foam layer to permit a user to adjust strap length while using the guitar strap over the user's shoulder to support a guitar.

10. The cushioning guitar strap according to claim 9, wherein the adjustment mechanisms are hook and loop fasteners, a thumb hold being provided on each adjustment mechanism on said side of said guitar strap corresponding to said one side of said foam layer for detaching and reattaching lock and loop portions of the fastener to adjust strap length.

11. A cushioning guitar strap comprising:

an elongated, flexible cushioning pad having a first end and a second end;

first coupling means connected to the first end and second coupling means connected to the second end for coupling the guitar strap to a guitar;

wherein said cushioning pad includes a flexible foam layer with a first surface on one side to conform to a user's shoulder under the load of a guitar, and a flexible film, which is dimensionally stable in use under the load of a guitar, bonded to a second surface on an opposite side of said foam layer to transfer the load over the area of the pad between said first and second ends;

wherein the flexible film has a thickness of 0.001 to 0.002 inch and a yield strength of at least 10,000 psi at ambient temperature.

12. A cushioning guitar strap comprising:

an elongated, flexible cushioning pad having a first end and a second end;

first coupling means connected to the first end and second coupling means connected to the second end for coupling the guitar strap to a guitar;

wherein said cushioning pad includes a flexible foam layer with a first surface on one side to conform to a user's shoulder under the load of a guitar, and a flexible film, which is dimensionally stable in use under the load of a guitar, bonded to a second surface on an opposite side of said foam layer to transfer the load over the area of the pad between said first and second ends;

wherein said foam layer is a soft foam having a hardness within the range of 1.0 to 4.0 pounds per square inch compression deflection 25%.

13. A cushioning shoulder strap comprising:

an elongated, flexible cushioning pad having a first end and a second end;

means for coupling said first end and said second end to an object;

wherein said cushioning pad includes a flexible foam layer with a first surface on one side to conform to a user's shoulder under the load of an object, and a flexible film, which is dimensionally stable in use under the load of an object, bonded to a second surface on an opposite side of the foam layer to transfer the load over the area of the pad between said first and second ends;

wherein said means for coupling includes a first strap connected to said first end of said cushioning pad and a second strap connected to said second end of said cushioning pad;

wherein each of said first and second straps has an adjustment mechanism permitting the user to adjust the length of each of said first and second straps for changing the height of an object supported on the body;

wherein the adjustment mechanisms are located at the ends of said first and second straps remote from the cushioning pad;

wherein each of said adjustment mechanisms has a quick connect-disconnect structure actuable by the user from a side of said shoulder strap corresponding to said one side of said foam layer to permit a user to adjust strap length while using the shoulder strap to support an object; and wherein the adjustment mechanisms are hock and loop fasteners, a thumb hold being provided on each adjustment mechanism on said side of said shoulder strap corresponding to said one side of said foam layer for detaching and reattaching hook and loop portions of the fastener to adjust strap length.

14. The cushioning shoulder strap according to claim 13, wherein a width of said elongated cushioning pad is at least four inches.

15. In a guitar strap comprising an adjustment mechanism to adjust strap length, the improvement comprising:

an elongated, flexible cushioning pad to conform to a user's shoulder under the load of a guitar, the cushioning pad being fixedly positioned along the length of the strap intermediate two opposite ends of the strap;

an adjustment mechanism to adjust strap length being located at each of the two opposite ends of the strap, each strap length adjustment mechanism having a quick connect-disconnect structure actuable by a user from a side of the guitar strap which faces the user's body to permit the user to adjust strap length and cushioning pad placement on top of the shoulder while using the guitar strap over the user's shoulder and connected to a guitar.

16. The guitar strap according to claim 15, wherein the quick connect-disconnect structure of each adjustment mechanism has hook and loop fasteners.

17. The guitar strap according to claim 15, wherein a thumb hold is provided on each adjustment mechanism at the end of the quick connect-disconnect structure on said side of the guitar strap for actuating said quick connect-disconnect structure to adjust strap length.

18. The guitar strap according to claim 15, wherein the elongated, flexible cushioning pad is securely attached at first and second ends of the pad to the strap intermediate the strap length adjustment mechanisms.

19. The guitar strap according to claim 15, wherein in each adjustment mechanism an adjustable length of the strap at the respective end of the strap is folded over and attached to the strap by the quick connect-disconnect structure to adjust strap length.

20. The guitar strap according to claim 15, wherein the cushioning pad has first and second ends and includes a flexible foam layer with a first surface on one side to conform to a user's shoulder under the load of a guitar, and a flexible film, which is dimensionally stable in use under the load of a guitar, bonded to a second surface on an opposite side of the foam layer to transfer the load over the area of the pad between the first and second ends of the pad.

21. The guitar strap according to claim 20, wherein the cushioning pad further includes a flexible covering over the foam layer and flexible film.

22. The guitar strap according to claim 20, wherein the foam layer is a soft foam having a hardness within the range of 1.0 to 4.0 pounds per square inch compression deflection 25%.

* * * * *